US005419061A

United States Patent [19]

Barrocas

[11] Patent Number: 5,419,061

[45] Date of Patent: May 30, 1995

[54] LIGHTED INSERT FOR FOOTWEAR AND METHOD

[76] Inventor: Jose E. Barrocas, 19720 NE. 23rd Ave., North Miami Beach, Fla. 33180

[21] Appl. No.: 269,694

[22] Filed: Jul. 1, 1994

[51] Int. Cl.[6] ..... A43B 23/00; F21L 15/08

[52] U.S. Cl. ..... 36/137; 362/103

[58] Field of Search ..... 36/137, 136, 139, 132; 362/103

[56] References Cited

U.S. PATENT DOCUMENTS

| | | | |
|---|---|---|---|
| 1,597,823 | 8/1926 | Randolph | 36/137 |
| 5,167,082 | 12/1992 | Chen | 36/137 |
| 5,188,447 | 2/1993 | Chiang et al. | 36/137 |
| 5,285,586 | 2/1994 | Goldston et al. | 36/137 |
| 5,303,131 | 4/1994 | Wu | 362/103 |
| 5,357,697 | 10/1994 | Lin | 362/103 |

FOREIGN PATENT DOCUMENTS

| | | | |
|---|---|---|---|
| 500247 | 8/1992 | European Pat. Off. | 36/29 |
| 2838770 | 3/1980 | Germany | 36/137 |
| 3343897 | 6/1985 | Germany | 36/137 |
| 3824352 | 2/1990 | Germany | 36/136 |

*Primary Examiner*—Steven N. Meyers

[57] ABSTRACT

A clear or translucent U-shaped insert has embedded within its cavity a light emitting module. The insert is preferably manufactured of polyvinyl chloride and conforms to the shape of the heel portion of footwear manufactured under the process of injection molding using polyvinyl chloride as the injected molten material. The light emitting module comprises a power source, electrical contacts, a plurality of light emitting devices and a switch engaging means. The insert is permanently molded into the sole of the footwear about the heel such that when the switch engaging means illuminates the light emitting devices, the devices can be viewed from the exterior of the footwear.

6 Claims, 4 Drawing Sheets

LIGHTED INSERT FOR FOOTWEAR AND METHOD

FIELD OF THE INVENTION

This invention relates to a lighted insert for use in footwear. More particularly, the insert comprises a sealed, self contained light emitting module. The insert is comprised of a clear or translucent material and is contiguous with the heel or sole of footwear.

BACKGROUND OF THE INVENTION

There is a need in the footwear industry to provide for lighted footwear which enables the wearer to be seen for security purposes. For example, lights in footwear are known to enable a wearer to be seen at nighttime where the wearer would not normally be viewed by another. This is particularly true when a driver of an automobile cannot, under ordinary night conditions, see a pedestrian due to poor or non-existent lighting.

In addition, the fashion aspect of lighted footwear has been well received by consumers who desire to wear new and different types of footwear. A number of these devices have been patented as exemplified by U.S. Pat. No. 2,941,315 to Irving et al.; U.S. Pat. No. 3,800,133 to Duval; U.S. Pat. No. 3,893,247 to Dana, III; U.S. Pat. No. 4,014,155 Reichert; U.S. Pat. No. 4,128,861 to Pelengaris; U.S. Pat. No. 4,253,253 to McCormick; U.S. Pat. No. 4,848,009 to Rodgers; U.S. Pat. No. 5,003,212 to Evanyk; and U.S. Pat. No. 5,285,586 to Goldston et al.

While the referenced prior patents achieve their intended purposes, they do not address the use of lights contiguous with injection molded footwear. These references generally relate to dress or casual footwear with large heels or heels that are removable. A number of the prior art patents provide access to the light emitting device, the power source or other circuitry in order to maintain those components. Still other references teach interchangeable light emitting devices or modules all of which do not address the inherent unitary structure of an injection molded sole or shoe.

In addition, the identified prior art do not disclose a light emitting module that requires no maintenance. They further do not teach a light emitting module that comprises the power and circuitry to produce a device that will last as long as the normal life span of typical footwear.

A further limitation of the designs depicted by the prior art is the failure to address the method of manufacturing a light emitting module contiguous with the sole of the shoe produced by the process of injection molding.

SUMMARY OF THE INVENTION

The present invention overcomes the difficulties and efficiencies of the prior art by disclosing and teaching a clear polyvinyl chloride ("PVC") U-shaped insert that conforms to the heel of footwear manufactured by the process of injection molding. A light emitting module is self contained and permanently sealed by epoxy or other means within a cavity contained in the insert. This light emitting module comprises a power source such as a battery, a lighting device such as a light emitting diode ("LED"), and electrical circuitry including a switching mechanism triggered by movement or contact of the footwear with an object thus engaging and disengaging the circuit and the lighting device.

It is still another object of the present invention to teach a light emitting module that requires no maintenance.

It is yet another object of the present invention to provide a light emitting module that will produce light during the normal life span of typical footwear.

It is a further object of the present invention to inject molten PVC into a footwear mold which forms the sole of a shoe and which chemically bonds with the PVC insert creating a solid bottom unit with the light emitting module embedded within the sole, yet being visible to the eye around the periphery of the shoe's heel's exterior.

BRIEF DESCRIPTION OF THE DRAWINGS

The features embodying the present invention are illustrated in the accompanying drawing, forming a part of this application, in which.

DETAILED DESCRIPTION OF A PREFERRED EMBODIMENT

Figure 1:
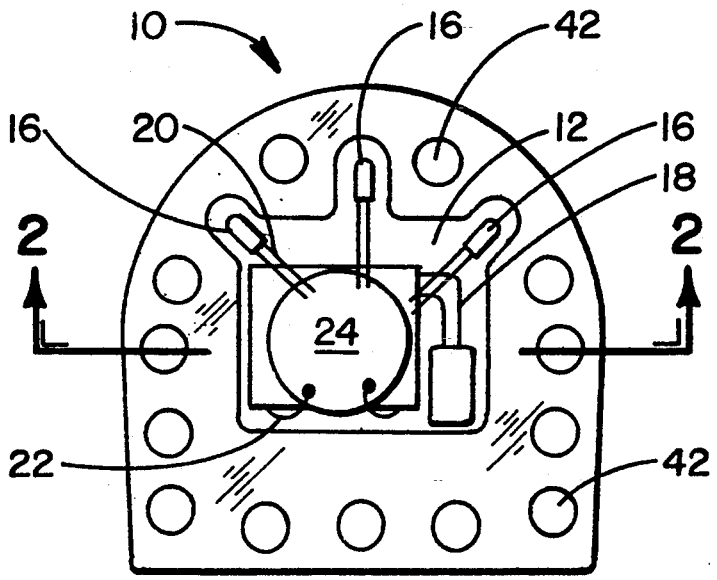
FIG. 1 is a top plan view of the present invention.
Figure 2:
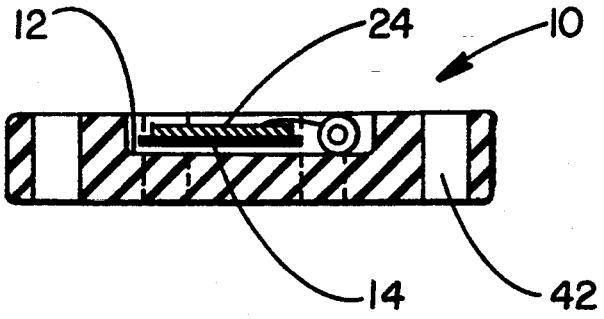
FIG. 2 is a cross section front view of FIG. 1 taken at line 2.

A detailed description of a preferred embodiment is seen in FIG. 1 and FIG. 2. In these figures, the present invention depicts an insert 10. The insert 10 is substantially U-shaped and solid having a semicircular end and an opposed flat end. The insert may be manufactured of any clear or translucent natural or synthetic material. However, it is preferred that the material be a clear polyvinyl chloride ("PVC"). PVC is preferred because the molding process hereinbelow described for the sole and heel of the intended footwear may also be comprised of PVC. The PVC of the insert 10, and the sole and heel when in molten, or injectable, form during an injection process, creates a chemical bonding or adherence to one another forming a contiguous, unitary sole.

The insert 10 has a cavity 12 which houses the light emitting module 14. The light emitting module 14 comprises a light emitting device 16, such as a light bulb or light emitting diode ("LED") that is selectively connectable by electrical contacts and circuit elements 18, 20, and 22 to a power source such as a battery 24. A plurality of light emitting devices 16 may be connected to the electrical contacts and circuit elements 18, 20 and 22; however, the present invention as illustrated shows three such devices.

Figure 3:
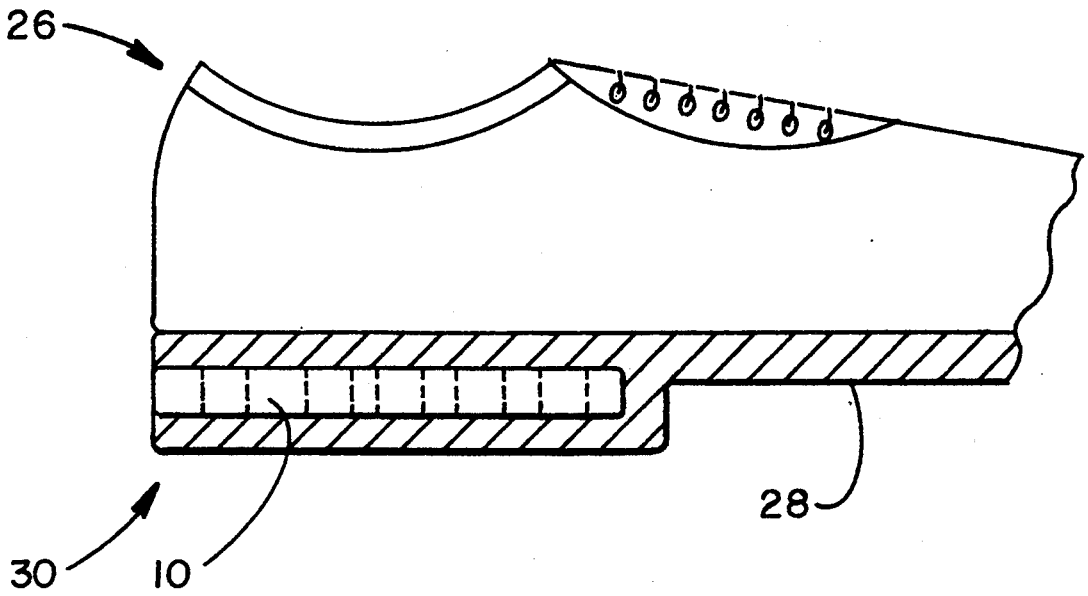
FIG. 3 is a fragmented, side elevation view of the present invention set into the sole of footwear.

The light emitting module 14 is encased in epoxy or similar substance within the cavity 12 of insert 10. This results in a self-contained, unitary insert 10 ready for introduction into the manufacturing process of the footwear. When set in footwear 26 as shown in FIG. 3, the clear insert 10 is in physical, contiguous contact with the sole 28 and outlines the periphery of the heel 30, where the outline is visible to the exterior of the footwear 26.

Figure 4:
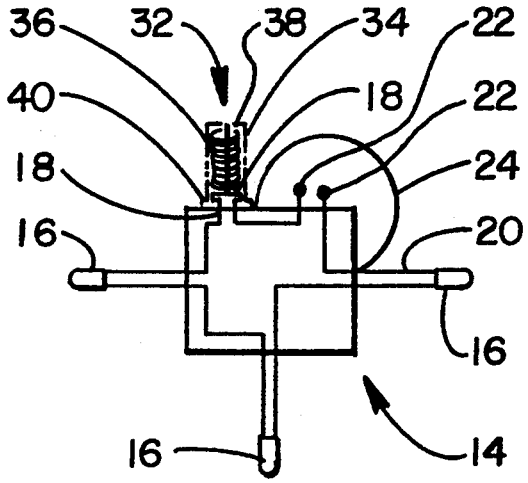
FIG. 4 is a plan view of the light emitting module with switch chamber shown in phantom lines.
Figure 5A:
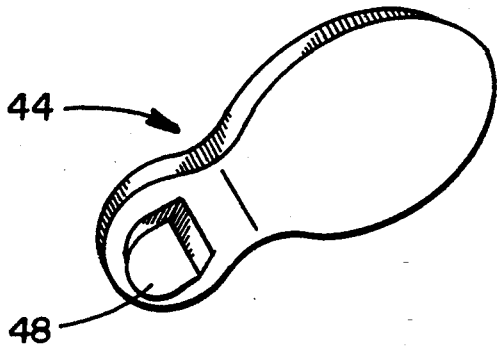
FIG. 5A is a bottom plan view of a shoe mold, or last.
Figure 5B:
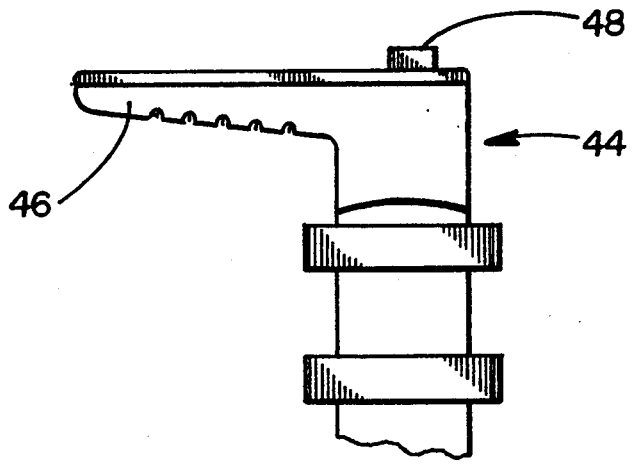
FIG. 5B is a side elevation of the last shown in FIG. 5A.
Figure 5C:
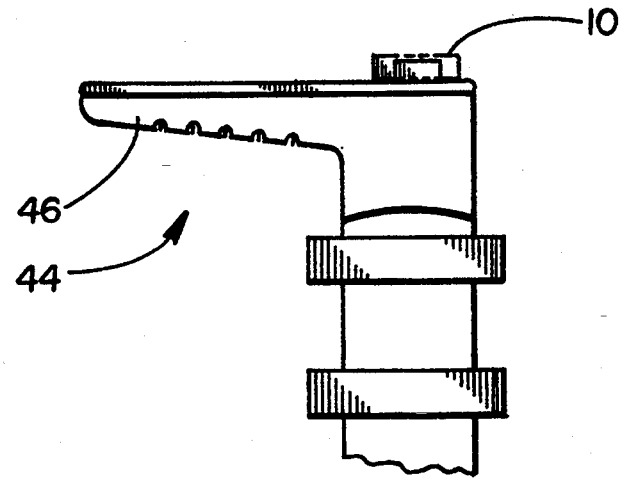
FIG. 5C is a side elevation of the last shown in FIG. 5B showing in phantom lines the light emitting module thereon prior to injection molding.
Figure 5D:
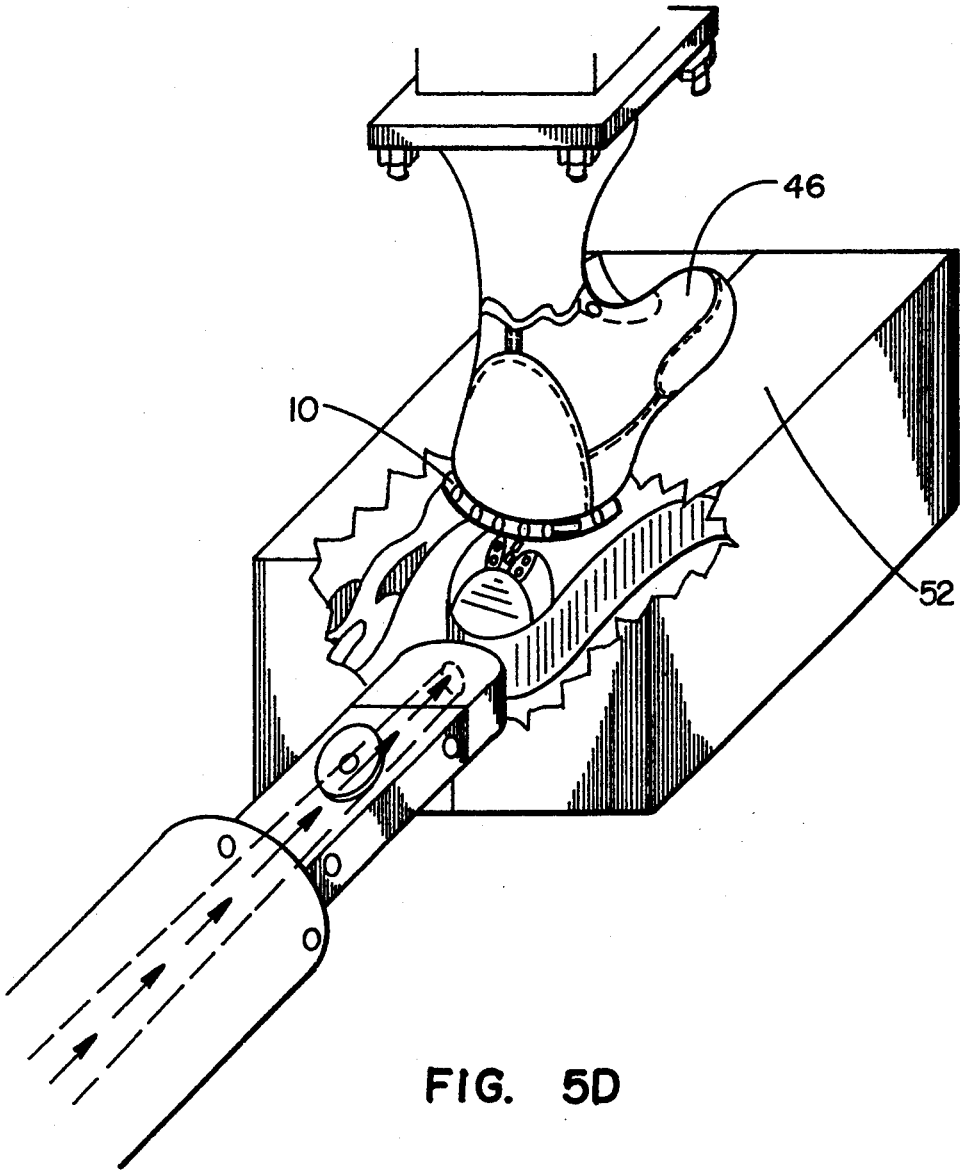
FIG. 5D is a perspective view of the last, a shoe upper and the present invention in a broken-away view of a ring injection mold in conjunction showing the flow of molten material during injection molding.

The light emitting module 14 is engaged and disengaged by completing the electrical connection of the battery 24 with the light emitting devices 16. The electrical connection is accomplished by a switching means 32. The switching means comprises a switch chamber 34 (shown in phantom lines in FIG. 4), a coiled spring wire 36 and a straight wire 38. The straight wire 38 is secured by soldering or other means to the switch chamber base 40 and connected by electrical contacts 18 to the battery 24 by electrical contacts 22. The coiled spring wire 36 is similarly secured to the switch chamber base 38 and connected to the light emitting devices 16 by electrical contacts 18.

The coiled spring wire 36 surrounds the straight wire 38, yet its upper coiled end is unattached and its movement is unencumbered. At rest, when the light emitting module 14 is not in motion, the coiled spring wire 36 is not in contact with the straight wire 38. Thus, there is no completion of an electrical circuit and the light emitting devices 16 are not illuminated. When the light emitting module 14 is in casual motion, such motion is generally insufficient to cause the flexible coiled spring wire 36 to come into contact with the straight wire 38 and to complete the circuit.

However, upon sudden movement of the light emitting module 14, the coiled spring wire has sufficient flexibility at its upper end to allow it to come into contact with the straight wire 38. The electrical circuit is then completed and the light emitting devices 16 are illuminated. When the sudden movement ceases, the coiled spring wire 36 relaxes away from the straight wire 38 and returns to its rested state thereby disconnecting the electrical circuit. It is disclosed and taught herein that when such a switching means 32 is used in a light emitting module 14 that is sealed within the cavity 12 of an insert 10 and formed in the sole 28 of footwear 26, the normal walking mode of the wearer of such footwear 26 is at least sufficient to cause the electrical circuit connection as this type of switching means 32 is engaged and disengaged when the footwear comes into contact with an object, such as a sidewalk or the ground, resulting in "sudden movement".

As discussed above, the PVC manufactured insert 10 chemically bonds with the molten, injectable PVC used to form the sole 28 of footwear 26 in an injection molding process. This process creates a unitary bond with the sole 28 and heel 30 thereof, and insert 10, and results in a single piece unit. The insert 10 can also have bores or apertures 42 to permit the molten PVC used in injection molded soles 28 to ooze therethrough and directly connect with itself which results in a molten PVC direct bond through the insert 10. It has been found that this bond strengthens the contiguous physical relationship of the insert 10 to the heel 30 of sole 28.

Figure 6:
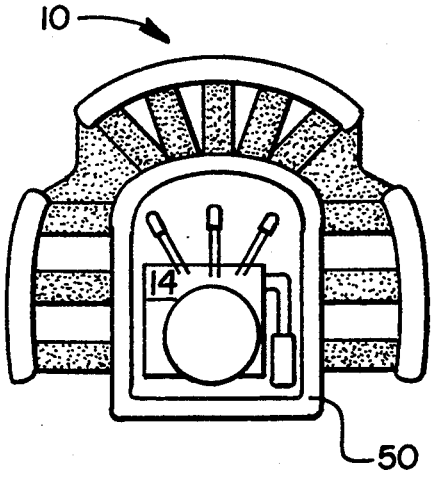
FIG. 6 is a top plan view of an alternative embodiment of the present invention.

In FIGS. 5A–D, the manufacturing of the footwear 26 is illustrated. A shoe mold, or last 44 has a shoe upper 46 secured about the last 44 by conventional means such as a drawstring (not shown). An additional insert mold 48 is secured to the last 44 by screws or other conventional means about the heel portion of the last 44. The insert 10 has a recess 50 (FIG. 6) that is matable with the insert mold 48 by pressure fitting it thereon. The last 44 is then placed in the ring mold 52 and molten material, in this case PVC is preferred, is injected forming the sole 28 of the footwear 26 (FIG. 3) and permanently embedding the insert 10 therein.

Alternatively, the insert 10 may take any shape or form so long as its outline is visible to the exterior of the footwear 26. An example of such an alternative embodiment may been seen in FIG. 6. In this embodiment, the insert mold 48 and recess 50 would be U-shaped.

It is intended that the description of the preferred embodiments of this invention is illustrative only. Other embodiments of the invention that are within the scope and concept of this invention are herein included with this application.

What is claimed is:

1. Lighted footwear comprising, in combination, a shoe having a sole and a heel thereof;

an insert having a cavity for permanently housing a light emitting module comprising a plurality of light emitting devices, electrical contacts and a power source, said insert having a substantial U-shape further comprised of a semi-circular end and an opposed flat end corresponding to the periphery of said heel;

a means for illuminating said light emitting module, said means comprsing a switch having a switch chamber base, a coiled spring wire and a straight wire therethrough upon which there is no contact at rest, said coiled spring wire being permanently affixed to said chamber base at one end and having a remaining upper free end such that when the footwear is in motion sufficient to cause the said upper end of the coiled spring wire to come into contact with the straight wire, an electrical circuit results illuminating the said light emitting devices; and, a means for securing said insert to the sole of said shoe.

2. In the lighted footwear of claim 1, said insert is clear.

3. In the lighted footwear of claim 1, said insert is translucent.

4. Lighted footwear comprising, in combination, a shoe having a sole and a heel thereof;

an insert having a cavity for housing a light emitting module comprising a plurality of light emitting devices, electrical contacts and a power source, said insert having a substantial U-shape further comprised of a semi-circular end and an opposed flat end corresponding to the periphery of said heel;

a means for illuminating said light emitting module, said means comprsing a switch having a switch chamber base, a coiled spring wire and a straight wire therethrough upon which there is no contact at rest, said coiled spring wire being permanently affixed to said chamber base at one end and having a remaining upper free end such that when the footwear is in motion sufficient to cause the said upper end of the coiled spring wire to come into contact with the straight wire, an electrical circuit results illuminating the said light emitting devices; and, a means for securing said insert to the sole of said shoe.

5. In the lighted footwear of claim 4, said insert is clear.

6. In the lighted footwear of claim 4, said insert is translucent.

* * * * *